US006005192A

United States Patent [19]

Mashikian et al.

[11] Patent Number: 6,005,192

[45] **Date of Patent: *Dec. 21, 1999**

[54] JACKET FOR INSULATED ELECTRIC CABLE

[75] Inventors: Matthew S. Mashikian; Joseph H. Groeger; John A. Tanaka, all of Storrs, Conn.; Bruce S. Bernstein, Rockville, Md.

[73] Assignee: University of Connecticut, Storrs, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/504,075

[22] Filed: Aug. 4, 1995

Related U.S. Application Data

[63] Continuation-in-part of application No. 08/130,053, Sep. 29, 1993, abandoned.

[51] Int. Cl.[6] ..... H01B 3/30

[52] U.S. Cl. ..... 174/110 R; 174/110 AR; 174/110 PM

[58] Field of Search ..... 174/110 R, 110 AR, 174/110 SR, 110 SY, 110 PM

[56] References Cited

U.S. PATENT DOCUMENTS

| | | | |
|---|---|---|---|
| 3,663,742 | 5/1972 | Hasebe et al. | 174/120 SC |
| 3,943,271 | 3/1976 | Bahder et al. | 174/23 R |
| 4,042,776 | 8/1977 | Matsuba et al. | 174/110 R |
| 4,071,461 | 1/1978 | Mears et al. | 252/63.5 |
| 4,097,682 | 6/1978 | Perry et al. | 174/15 R |
| 4,322,574 | 3/1982 | Bow et al. | 174/107 |
| 4,347,288 | 8/1982 | Minnema et al. | 428/389 |
| 4,400,429 | 8/1983 | Barlow et al. | 428/379 |
| 4,454,379 | 6/1984 | Cleveland et al. | 174/107 |
| 4,492,647 | 1/1985 | Braus | 252/573 |
| 4,623,755 | 11/1986 | Henkel et al. | 174/110 SR |
| 4,626,619 | 12/1986 | Uematsu | 174/106 SC |
| 4,724,248 | 2/1988 | Dexter et al. | 174/110 SR |
| 4,743,644 | 5/1988 | Skipper et al. | 524/437 |
| 5,217,667 | 6/1993 | Griffith | 264/152 |
| 5,237,014 | 8/1993 | Barnabeo | 525/291 |
| 5,246,783 | 9/1993 | Spenadel et al. | 428/461 |
| 5,492,760 | 2/1996 | Sarma et al. | 428/378 |

*Primary Examiner*—Kristine Kincaid
*Assistant Examiner*—Chau Nguyen
*Attorney, Agent, or Firm*—Fish & Richardson P.C.

[57] ABSTRACT

An improved jacket material for insulated electric cable wherein the jacket contains one or more additives of an ion exchange resin and/or an ionic scavenging compound for neutralizing or capturing ionic impurities.

3 Claims, 2 Drawing Sheets

JACKET FOR INSULATED ELECTRIC CABLE

This is a continuation-in-part of Ser. No. 08/130,053, filed Sep. 29, 1993 now abandoned, which is incorporated-by-reference herein.

BACKGROUND OF THE INVENTION

The present invention relates generally to improved jackets for insulated electric cables, and more particularly to jacket materials containing additives that effectively remove or inhibit the passage of ionic impurities into the insulation of the cable which can weaken the insulative properties.

Electric cables have been used extensively since about 1960 and were originally intended to be serviceable for a period in excess of 40 years. However, there have been premature failures of these cables, the major cause of which has been attributed to the formation of water trees, which are dendritic structures within the insulative layers that considerably weaken the dielectric properties of the cable insulating materials. The points of initiation of the water trees seem to be defects in the insulation such as impurities, aggregated admixtures, voids, gaps, cracks or boundary surfaces. While the mechanism of water tree formation is not fully understood, some studies have demonstrated that ionic impurities contained in groundwater are major promoters of water treeing. Insulated cables typically have an outer jacket which provides protection against physical damage and water diffusion into the insulation when the cable is buried. However, the many commonly used cable jacket materials still apparently do not adequately protect the insulation materials from water treeing.

There have been several attempts to solve this problem. In some cases a thin metal water barrier, typically made of lead or aluminum is placed between the jacket and the insulation shield. While such metal barriers prevent the ingress of water, they add considerably to the manufacturing cost of the cable. Moreover the use of metal barriers generates a set of technical problems, including metal corrosion and/or cracking due to thermal expansion and contraction. The metal barriers also add significant weight to the cable. For these reasons, use of a metal water barrier beneath the jacket has not been widely accepted.

A typical cable comprises a conductor core, surrounded by a conductor shield (usually a thin layer of semiconducting material which is compatible with the conductor), followed by insulating material, a second shield (which is another layer of semiconducting material used to cover and protect the cable insulation), a set of helically applied copper conductors or tapes (used as a ground or neutral conductor), then a jacket, usually extruded over the copper conductors, to impede the ingress of water. As another proposed solution for protecting cables, the conductor strands may be treated with water blocking compounds such as polymeric sealants. However, the long term effectiveness of these compounds for use for that purpose is not known.

The present invention provides an improved jacket which prevents or significantly retards the ingress of harmful ionic impurities from passing through the jacket into the insulation materials, thereby preventing or impeding the growth of water trees.

SUMMARY OF THE INVENTION

According to the present invention, a protective jacket for insulated cable is provided which comprises a polymer and an effective amount of an additive distributed in the polymer to inhibit water tree formation in the insulation layer.

DETAILED DESCRIPTION OF THE INVENTION

The additives are distributed in the jacket material surrounding the cable insulation. The amount of additives required is typically in the range of 5 to 20 percent by total weight with the jacket material, with the range of 5 to 10 percent by weight being particularly useful. While not intending to be bound by a theory, it is believed that the additives form non-migrating micropolar sites within the relatively non-polar polymeric jacket material. Ionic impurities carried into the relatively non-polar material of the jacket will become attracted to the polar sites within the jacket material and either react or adhere to those sites.

In general, the additives fall into three categories of compounds:

1) Mixed bed ion exchange resins;
2) Cationic exchange resins containing tertiary amines; and
3) organic or inorganic ion scavengers.

These additives include sulfonic acid cationic exchange resins, carboxylic acid cationic exchange resins, carboxylic ionomers, quaternary ammonium hydroxide ion exchange resins, tertiary amine anionic capture resins, zeolites, activated bauxite and ionomers. These may be used alone or in combinations.

Figure 1:
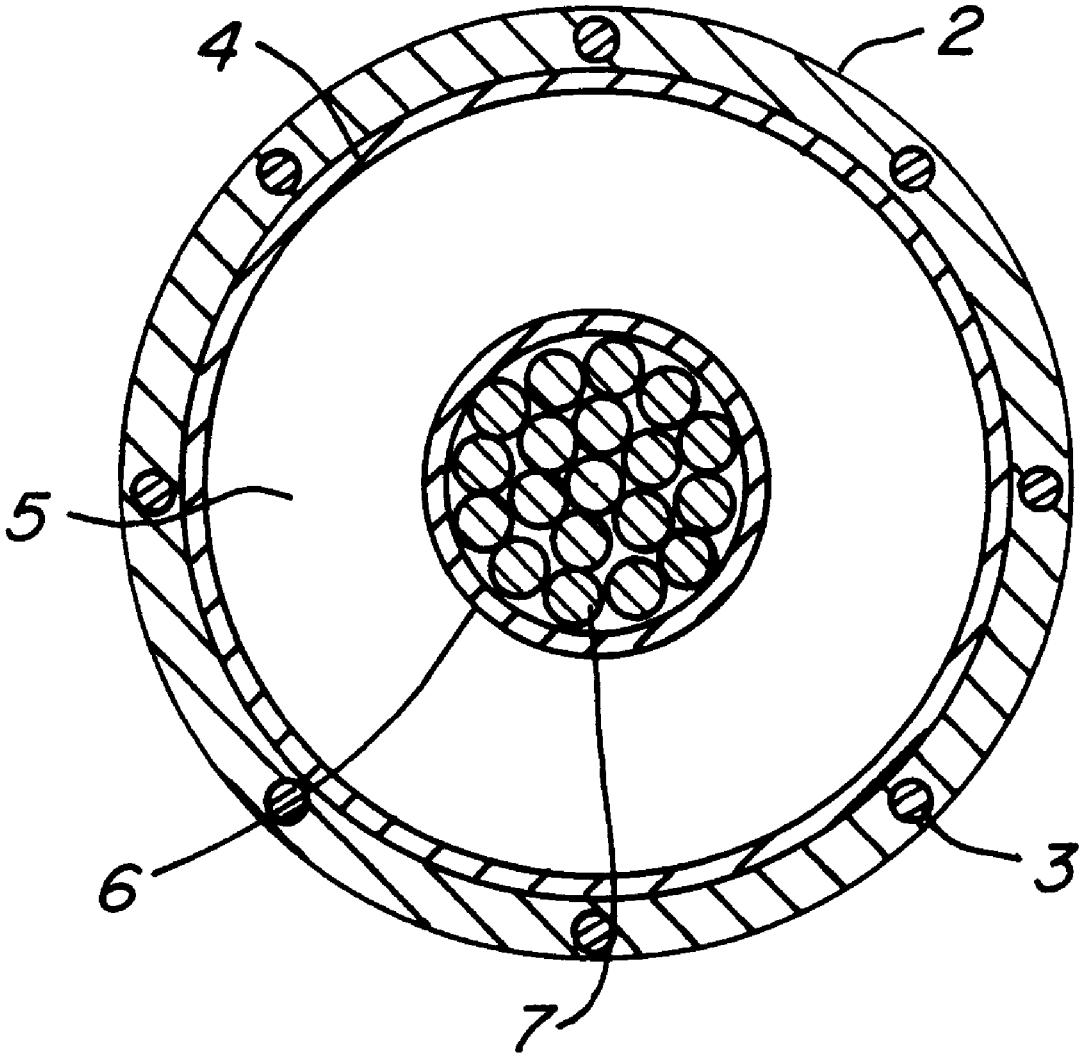
FIG. 1 is a cross-sectional view of a jacketed underground residential distribution (URD) electrical cable.

Referring to FIG. 1, is shown the cross-section of a typical underground residential distribution (URD) cable.

The core will comprise solid or stranded electrical conductor 7, typically made of stranded copper or aluminum. A semi-conducting shield 6 provides an equipotential layer between the cable insulation 5 and the conductor 7. The shield is typically a carbon-loaded polymer. The cable insulation layer 5 is typically extruded over the shield 6. Typical insulation materials are a cross-linked polyethylene (XLPE) or ethylene-propylene rubber (EPR). A second shield 4 is typically provided to cover the insulation material. The shields 4 and 6 are both typically carbon black loaded polymers. However, the shield 6 is maintained at the high electric potential of the conductor core 7 while the outer shield 4 is maintained at ground potential. Neutral wires 3, typically copper, on the exterior of the shield 4 are maintained at ground potential. Therefore, the electric field resulting from the application of voltage to the core is confined to a volume of insulation 5 between the shields 4 and 6. Typically the jacket 2 is made of a polymer which has some basic ingredients to impart a black color to it but not of a type, or sufficient amount to make it conducting, as well as anti-oxidants and processing aids to facilitate extrusion of the jacket over the entire cable. Since the jacket is outside the electric field, it is not subjected to the field as an aging factor. Although the base polymer materials of which the shields 4 and 6 and insulation 5 are made are individually insulating in nature, only the layer 5 is referred to as the insulation. Thus there is a distinction made among the insulation 5, the shields 4 and 6 and the jacket 2.

Typically, a jacket is made of a material such as polyethylene or polyvinyl chloride and the additives as provided herein are homogeneously distributed within the jacket. By homogeneous distribution, it is meant that conventional processing procedures are used to mix the additives with the polymer in a thorough manner, such as by using a mixing extruder or a Brabender-type batch mixer. Typically, the organic additives are ground to a particle size in the range of approximately 25 to 100 micrometers, then dried under vacuum. The base polymer resin and the additives are then mixed in an extruder or batch mixture. The inorganic additives are milled to a fine powder, typically a grain size in the range of 5 to 50 micrometers before drying and vacuum treating, and mixing with the host polymer resin.

It is an important feature of the invention to locate the ion scavenger materials in the jacket, outside of the influence of the electric field of the central electrically conducting core. While not intending to be bound by a particular theory, it is believed that the normal environment of the cable insulation layer comprises two major aging factors: electric stress due to the electric fields of the central conducting core, and heat due mainly to the load current in the conducting core. While the two most common polymer insulating material in high voltage cables are polyethylene or crosslinked polyethylene and ethylene propylene rubber, both materials have excellent dielectric properties capable of providing long life and low loss in the normal environment of electrical stress and heat. However, the undesirable interference with this normal environment comes from the groundwater with its high ionic impurity content. It is believed that ionic impurities dissolved in groundwater migrate through the jacket of the prior art and the outer shield, to invade the cable insulation to promote water trees. However, by use of the present methodology, the ionic impurities are captured at the outer jacket.

It is therefore an advantage of the present invention in that the additives are not added to the insulation layer since such additives will typically reduce the dielectric properties of the insulation layer. When the dielectric constant of the insulation is increased, there is an increase in wasteful leakage current through the insulation. Moreover, the use of the additives in the insulation layer is believed to be counterproductive since it will capture ionic impurities which penetrate the jacket and outer shield, to insure that they will remain part of insulation to provide sites for future water tree formation. Furthermore, when ion scavenging inorganic fillers are added to the insulation layer they typically do not bind well to the nonpolar insulation such as polyethylene or EPR. As a result, a high electric field which can be present in the insulation layer, particularly near the central core, can create partial discharge and electrical trees and the voids left around the filler particles can shorten the cable life. Thus, the scavenging fillers, when used in the insulation layer, would need to be surface treated with material such as silane to facilitate bonding of the fillers with the base polymer of the insulation. However, if the fillers are surface treated so that they bind better to the base polymer of the insulation, the surface treatment will tend to prevent water (and therefore the ionic impurities in the water) from directly contacting the scavengers, which would significantly decrease or completely block their capability to scavenge the harmful ions contained in the water.

The preferred additives are zeolites, and activated bauxites, which may be used alone or in combinations. Typically, cationic exchange materials will exchange a hydrogen ion for a positive ion while anionic exchange materials exchange a hydroxide ion for a negative ion whereby hydrogen and hydroxide ions that are generated in the jacket area will combine to form water. In the absence of ionic impurities, pure water is not considered to be a significant contributor to cable degradation by water treeing.

The amount of ion exchange or ion scavenging additives used in the jacket material will typically vary between 5 and 20 percent of the total weight of the jacket material. The mixing characteristics of the additive to the base polymer of the jacket material will be affected by the type of additive, its particle size and the nature of the base polymer. Typical particle size for the additives may be in the range of 25 to 100 micrometers for organic additives and 5 to 50 micrometers for inorganic additives. The optimum particle size depends upon, among other factors, the type of additive, the relative amount of the additive, thickness of the jacket, the nature of the host material and the weight percent of the additive used, i.e. known as the load of the content.

Figure 2:
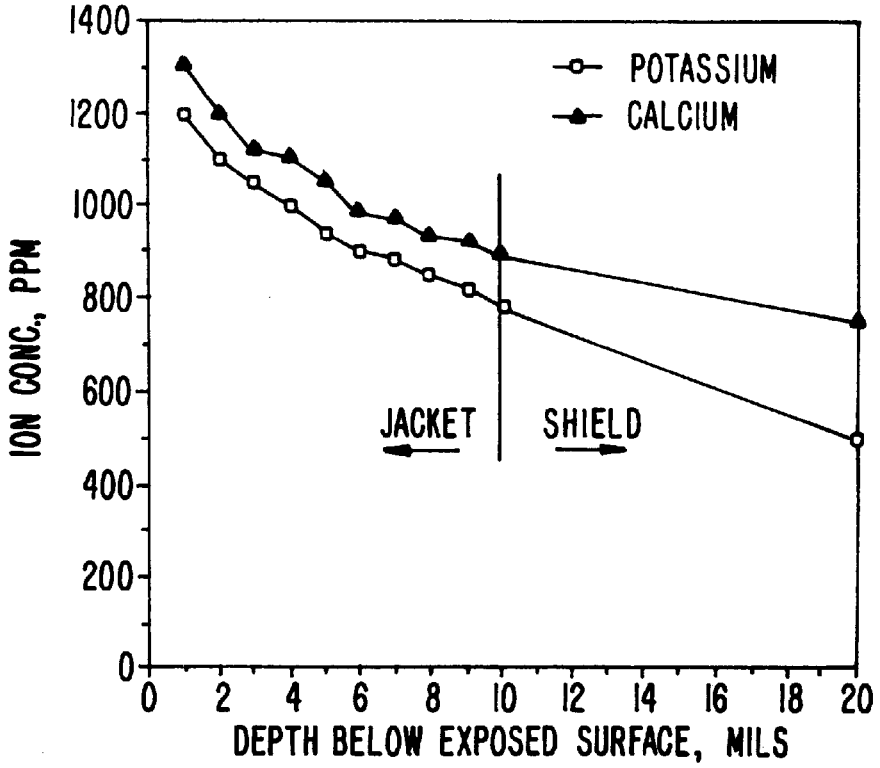
FIG. 2 is a potassium and calcium ion concentration profile in a cable jacketed with a prior art jacketing material.

Referring to FIG. 2, there are shown the results of an ion penetration test. An ion penetration test was conducted on a conventional cable comprising an outer cable jacketing material (polyethylene) a semiconducting outer shield (carbon black filled with EVA) placed on a layer of electrically stressed insulation made of XLPE. The cable jacket outer surface was exposed to a solution containing calcium and potassium ions. The concentration of calcium and potassium ions penetrating the jacket and shields were measured after 6,660 hours of aging. As can be seen from the figure, both ions not only penetrated the jacket but also the shield at about 500 ppm potassium and about 800 ppm of calcium 20 mils. beneath the outer surface of the jacket.

Figure 3:
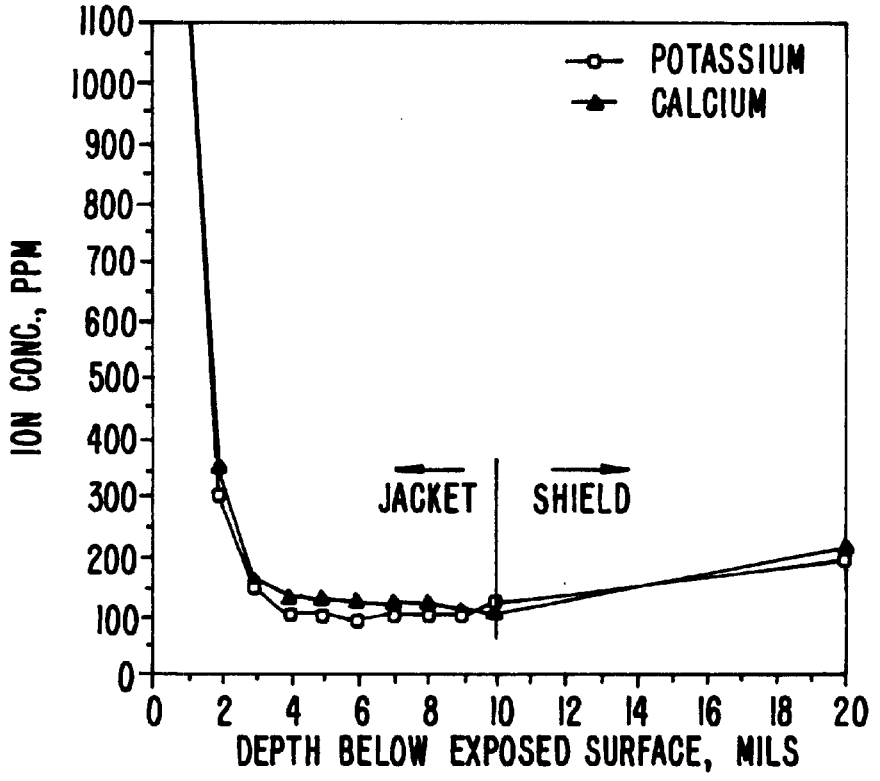
FIG. 3 is a potassium and calcium ion concentration profile in a cable having an improved jacket containing additives as described hereinbelow.

Referring to FIG. 3, a second set of tests was conducted except the cable jacket material was replaced with polyethylene modified with five percent by weight of zeolite. As can be seen from FIG. 3, beyond the depth of about four mils. into the jacket, the potassium and ion concentrations were in the order of 100 ppm. In the shield, the potassium and ion concentrations were no higher than about 200 ppm.

What is claimed is:

1. An electrically conducting cable comprising a conductor core circumferentially surrounded by an interior shielding layer;

an annular insulating layer consisting essentially of crosslinked polyethylene or ethylene-propylene rubber, said insulating layer circumferentially surrounding said interior shielding layer;

an exterior shielding layer circumferentially surrounding said insulating layer;

neutral conducting elements helically wound over said exterior shielding layer;

a protective jacket circumferentially surrounding said exterior shielding layer and neutral elements and circumferentially enclosing said cable;

wherein said protective jacket comprises a polymeric base polymer and an additive comprising about 5 to 20% by weight of said jacket, said additive distributed within said base polymer to inhibit water tree formation in said insulation layer caused by penetration of ionic substances from the environment through said jacket and said exterior shielding layer into said insulating layer.

2. An electrically conducting cable comprising a conductor core circumferentially surrounded by an interior shielding layer;

an annular insulating layer consisting essentially of crosslinked polyethylene or ethylene-propylene rubber, said insulating layer circumferentially surrounding said interior shielding layer;

an exterior shielding layer circumferentially surrounding said insulating layer;

neutral conducting elements helically wound over said exterior shielding layer;

a protective jacket circumferentially surrounding said exterior shielding layer and neutral elements and circumferentially enclosing said cable;

wherein said protective jacket comprises a polymeric base polymer and an effective amount of at least one additive distributed within said base polymer having a particle size in the range of about 5 to 100 micrometers to inhibit water tree formation in said insulation layer caused by penetration of ionic substances from the environment through said jacket and said exterior shielding layer into said insulating layer.

3. An electrically conducting cable comprising a conductor core circumferentially surrounded by an interior shielding layer;

an annular insulating layer consisting essentially of cross-linked polyethylene or ethylene-propylene rubber, said insulating layer circumferentially surrounding said interior shielding layer;

an interior shielding layer circumferentially surrounding said insulating layer;

neutral conducting elements helically wound over said exterior shielding layer;

a protective jacket circumferentially surrounding said exterior shielding layer and neutral elements and circumferentially enclosing said cable;

wherein said protective jacket comprises a polymeric base polymer and an effective amount of a mixture of zeolites and activated bauxites distributed within the base polymer to inhibit water tree formation in the said insulation layer caused by penetration of ionic substances from the environment through said jacket and said exterior shielding layer into said insulating layer.

* * * * *